United States Patent [19]

Polan et al.

[11] Patent Number: 4,711,099

[45] Date of Patent: Dec. 8, 1987

[54] PORTABLE QUICK CHILLING DEVICE

[75] Inventors: George S. Polan, North Wales, Pa.; Hermann R. Glinecke, Morrisville, N.J.

[73] Assignee: Central Sprinkler Corporation, Lansdale, Pa.

[21] Appl. No.: 902,242

[22] Filed: Aug. 29, 1986

Related U.S. Application Data

[63] Continuation-in-part of Ser. No. 893,505, Aug. 5, 1986, abandoned.

[51] Int. Cl.[4] ..... F25D 3/08

[52] U.S. Cl. ..... 62/457; 62/293; 62/371; 62/504; 62/530

[58] Field of Search ..... 62/504, 511, 516, 518, 62/530, 457, 371, 293

[56] References Cited

U.S. PATENT DOCUMENTS

| | | | |
|---|---|---|---|
| 1,671,531 | 5/1928 | Kuhl | 62/457 |
| 1,993,171 | 3/1935 | Hyde | 62/518 |
| 2,049,708 | 8/1936 | Lieb | 62/518 X |
| 2,147,788 | 2/1939 | Gay | 62/504 X |
| 2,401,613 | 6/1946 | Charland | 62/457 X |
| 2,481,228 | 9/1949 | Layne | 62/457 X |
| 2,926,504 | 3/1960 | Hellinger | 62/457 X |
| 3,048,021 | 8/1962 | Coles et al. | 62/511 X |
| 3,172,272 | 3/1965 | Alsing | 62/511 X |
| 3,213,635 | 10/1965 | Jacobs | 62/511 X |
| 3,315,486 | 4/1967 | Chien et al. | 62/504 X |
| 3,452,555 | 7/1969 | Thurman et al. | 62/298 |
| 3,553,976 | 1/1971 | Cumine et al. | 62/294 |
| 4,054,037 | 10/1977 | Yoder | 62/224 |
| 4,130,997 | 12/1978 | Hara et al. | 62/504 |
| 4,571,740 | 2/1986 | Kirby et al. | 62/371 X |
| 4,573,329 | 3/1986 | Cavalli | 62/518 X |
| 4,581,898 | 4/1986 | Preis | 62/3 |

*Primary Examiner*—Lloyd L. King

*Attorney, Agent, or Firm*—Seidel, Gonda, Goldhammer & Abbott

[57] ABSTRACT

The present invention is directed to a portable quick chilling device. A compressor is affixed to a base. A condenser is operatively connected to the compresser. A fan is provided for blowing air across the condenser. An accumulator is operatively connected to the condenser. A capillary tube (expansion valve) is operatively connected to the accumulator. The capillary tube is operatively connected to an evaporator. The evaporator is operatively connected to the compressor. The evaporator is a coil of tubing. Each ring of the coil is in contact with an adjacent ring. An inwardly facing surface of each ring is flattened. The capillary tube enters the coil where said evaporator is operatively connected to the compressor. The tube passes within the coil. The free end of the tube is bent to point back down the coil. The device cools a 12 ounce beverage can from about 75° F. to about 45° F. in about 4 minutes.

23 Claims, 8 Drawing Figures

PORTABLE QUICK CHILLING DEVICE

This patent application is a continuation-in-part of co-pending U.S. patent application Ser. No. 893,505, entitled "Portable Quick Chilling Device", filed Aug. 5, 1986 now abandoned by G. S. Polan and H. R. Glinecke.

SCOPE OF THE INVENTION

The present invention is directed to a portable quick chilling device. The specified embodiment is directed to a chilling device which cools a beverage in a twelve ounce can from about 75° F. to about 45° F. in approximately four minutes.

BACKGROUND OF THE INVENTION

Consumers of canned beverages, alcoholic and nonalcoholic, prefer the beverage cooled. Preferably, the beverage is cooled to about 45° F. for optimum enjoyment. Cooling of the canned beverage requires either refrigerating or icing. In either case, a large apparatus (refrigerator) or a large cold mass (ice) is required to sufficiently cool the beverage. Thus, prior art methods of cooling are not always portable. Additionally, these prior art methods of cooling are not always quick. Yet, a consumer who is hot and thirsty desires instant relief from heat and thirst. Such relief may come from a quickly cooled beverage in a can.

U.S. Pat. No. 3,452,555 is directed to a portable ice cream freezer. The freezer comprises an evaporator which telescopically embraces an ice cream container. The evaporator is operatively connected, in series, to a compressor, a condenser, and a restricted duct. A fan is operatively associated with the condenser. The evaporator, in a first embodiment, is a longitudinally split, double-walled closed cavity, cylindrical sleeve. In a second embodiment, the evaporator is a coil of tubing which surrounds the side and bottom walls of the container. The tubing is isolated from the container by a shell and a bottom wall. Each ring of the coil has a space therebetween. The coil is encased in an insulating material, such as styrofoam.

U.S. Pat. No. 3,553,976 discloses a container refrigerator. The refrigerator comprises a compressed refrigerant and a chamber for storing and/or expanding the compressed refrigerant. The refrigerator is disposable because the refrigerant is allowed to escape into the atmosphere. In a first embodiment of the invention, the refrigerant is stored and expands in the chamber. (FIGS. 1–4). In a second embodiment (FIG. 6), the expansion chamber comprises a first spiral coil having rings which have a rectangular cross-section. The compressed refrigerant is stored in a second spiral coil which overlays the first coil.

U.S. Pat. No. 4,054,034 is directed to a portable apparatus for cooling beverage containers. The apparatus comprises an evaporator, a flow restriction valve, and a source of compressed refrigerant. The evaporated refrigerant is vented to the atmosphere. The source of compressed refrigerant is disposable and interchangable. The evaporator, FIG. 4, comprises a longitudinally split cylindrical sleeve having a plurality of circumferential channels formed therein. The channels are defined by a smooth inner wall and an outer wall having the channels formed therein.

SUMMARY OF THE INVENTION

The present invention is directed to a portable quick chilling device. The device comprises a base. A compressor means is affixed to the base. A condenser means is operatively connected to the compressor means such that a compressed refrigerant is received by the condenser means. A refrigerant accumulating means is operably connected to the condenser means such that the condensed refrigerant is received by the accumulating means. An expanding means is operatively connected to the accumulating means such that the condensed refrigerant in the accumulating means can escape through the expansion means. The expanding means is a capillary tube having a free end. An evaporator means is operatively connected to the expanding means. Escaping refrigerant from the accumulating means is introduced into the evaporator means. The evaporator means is operatively connected to the compressor means. The evaporator means includes a coil of tubing. Each ring of the coil is in direct contact with an adjacent ring. An inwardly facing surface of each ring is flattened. The capillary tube enters the coil where the evaporator means is operatively connected to the compressor means. The tube passes within the coil. The free end is bent to point back down the coil.

DETAILED DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 8 is a side view of an alternate evaporator made according to the present invention, parts being broken away for clarity.

DETAILED DESCRIPTION OF THE PREFERRED EMBODIMENT

Figure 1:
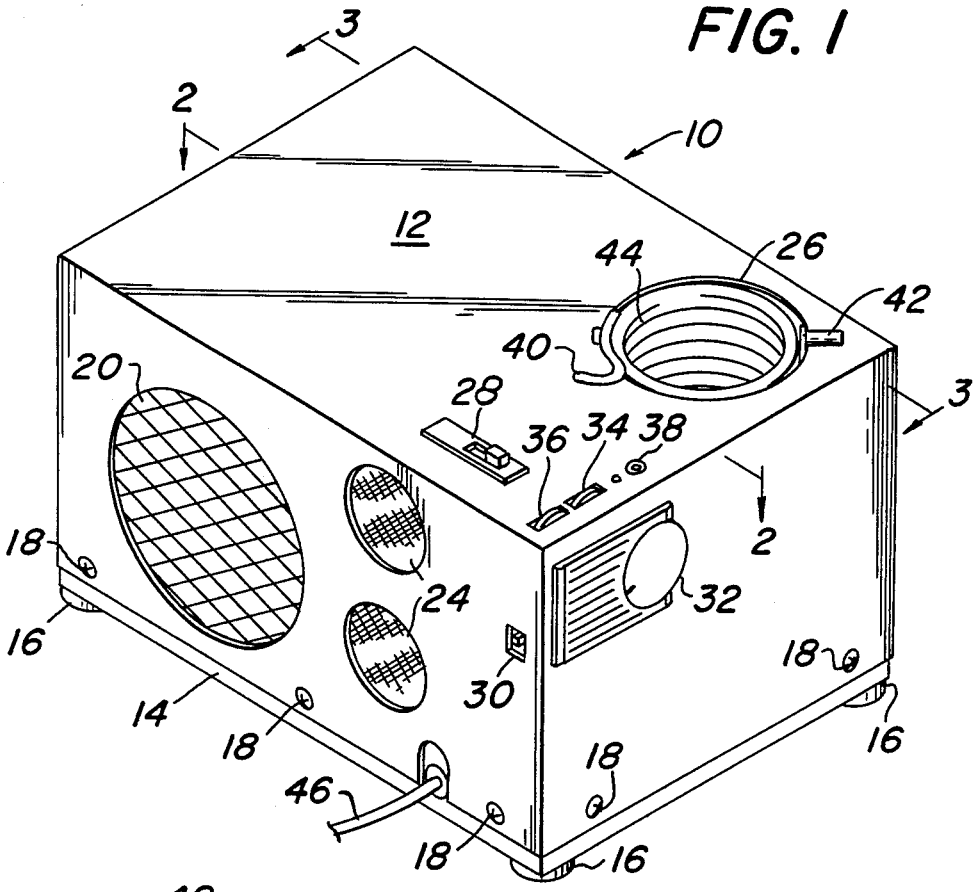
FIG. 1 is an isometric view of the preferred embodiment of the present invention.

Referring to the drawings, wherein like numerals represent like elements, there is disclosed a portable quick chilling device generally denoted 10. The device 10 is lightweight and weighs about 20 pounds. The device 10 can chill a beverage from about 75° F. to about 45° F. in about 4 minutes.

The chilling device 10 has a base 14. The base 14 is generally rectangular in shape and has legs 16 secured thereto. A leg is placed at each corner of the base 14. Legs 16 are fastened to base 14 by fasteners 82. A housing 12 is generally rectangular in horizontal and vertical cross section and is fastened to base 14 by a plurality of fasteners 18. Fasteners 18 can be sheet metal screws. An exhaust port 20 is located in a vertical side of housing 12. Exhaust port 20 is generally circular in shape, although any shape would be sufficient. An inlet port 92 (not shown) is located in the housing side opposite exhaust port 20. Two speaker ports 24 are adjacent inlet port 20. A mesh screen 22 covers port 24, and like screens cover ports 22 and 92. An opening 26 is located on the uppermost horizontal surface of the housing 12. The significance of opening 26 will be described in detail later.

A power on/off switch 28 is provided on the uppermost horizontal surface of the housing. Switch 28 initiates and terminates the action of the chiller.

Figure 2:
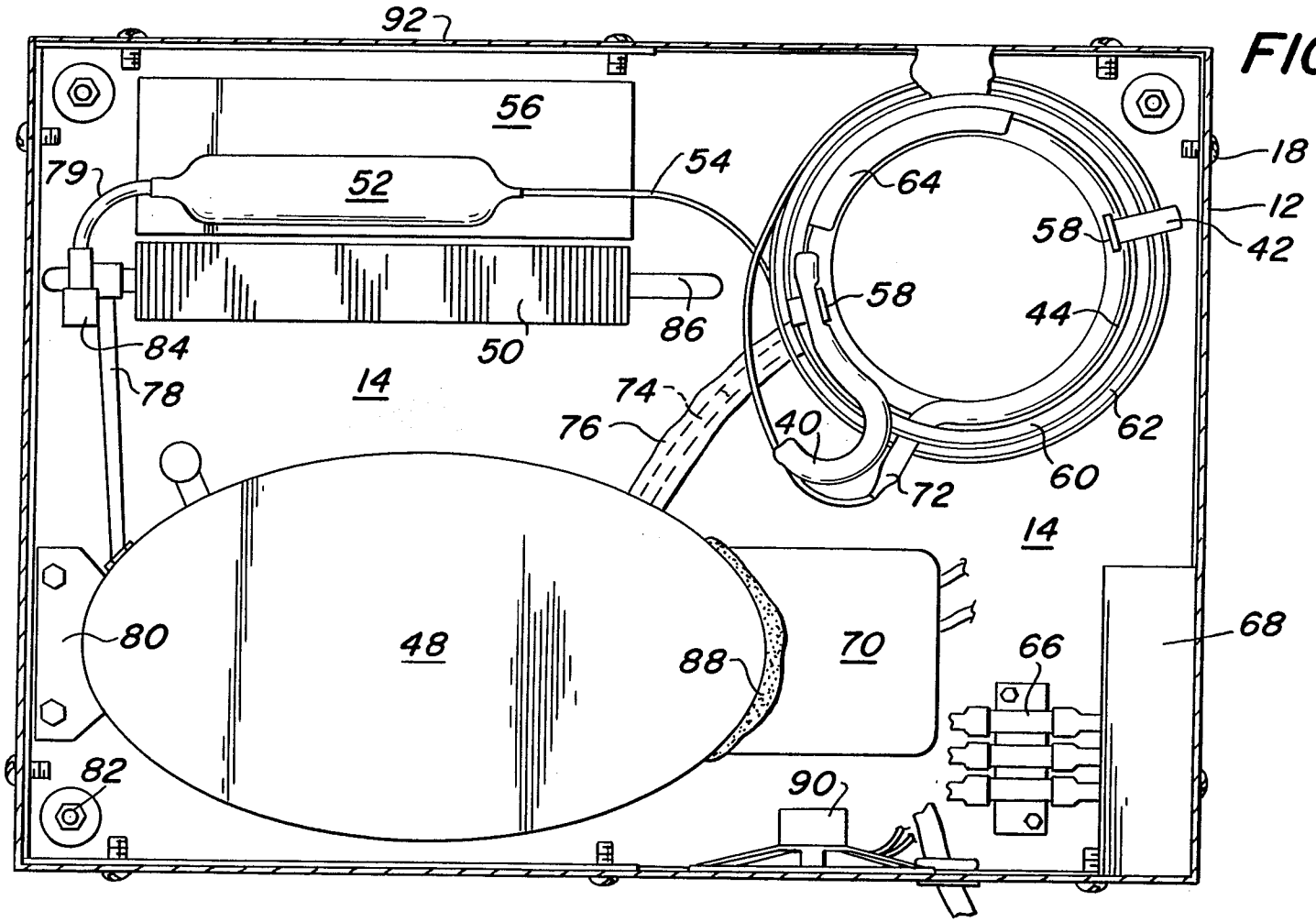
FIG. 2 is a sectional view of the present invention taken generally along lines 2—2 of FIG. 1.
Figure 3:
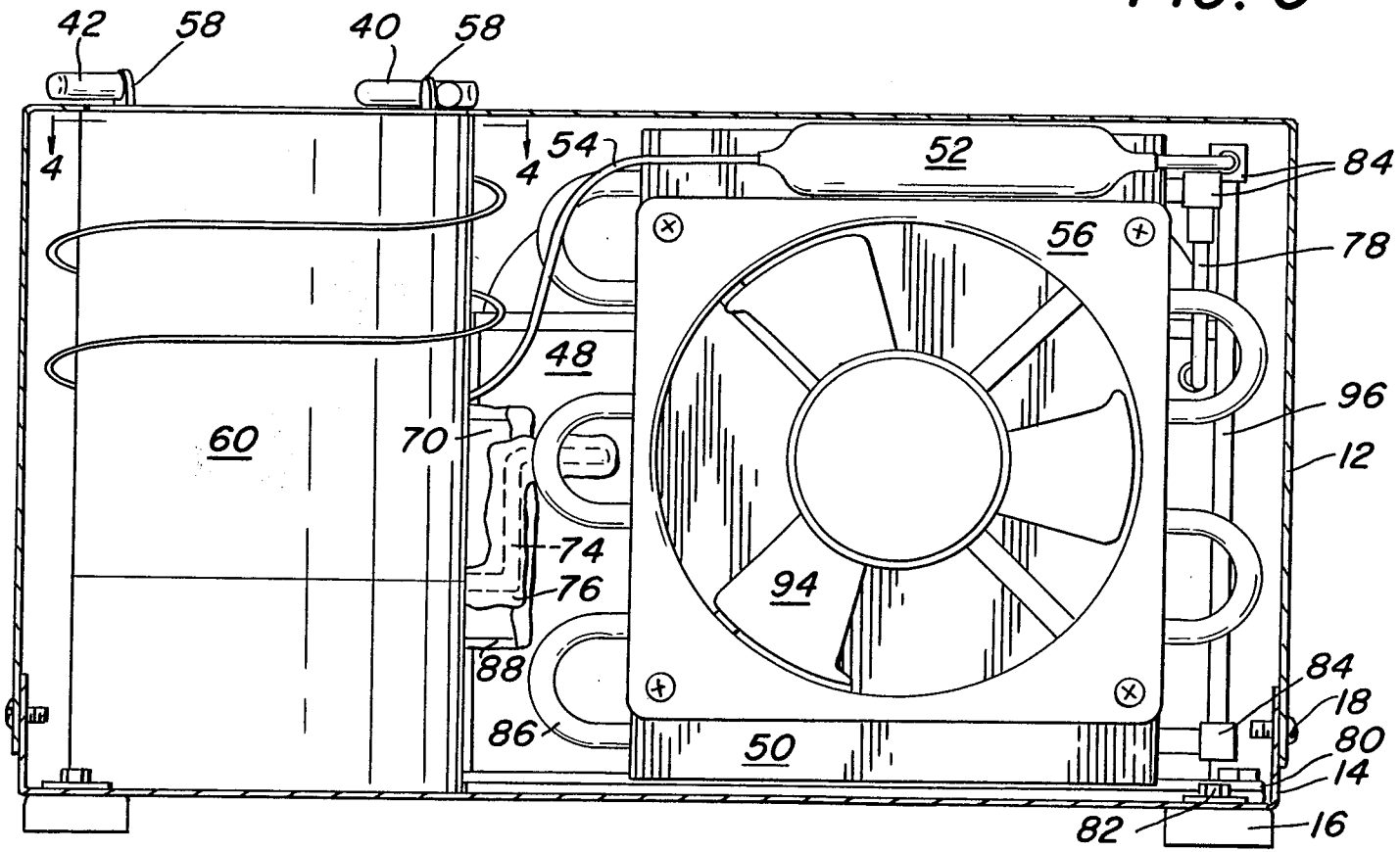
FIG. 3 is a sectional view of the present invention taken generally along line 3—3 of FIG. 1.

A radio receiver 68 is affixed to the inside of housing 12. See FIG. 2. Radio receiver 68 is any conventional radio, such as a miniature AM/FM stereo radio receiver. Openings in housing 12 are provided for radio on/off switch 30, station indicator 32, volume control thumbwheel 34, tuning control thumbwheel 36, and ear phone jack 38. Speakers 90 are mounted on the inside of housing 12 adjacent speaker ports 24 in any conventional manner.

An electrical power supply line 46 extends from within housing 12. The electrical power supply line 46 includes a plug which may be inserted in a power supply such as an ac outlet or a cigarette lighter socket in a car. The line provides electrical energy to the chiller and radio.

Figure 7:
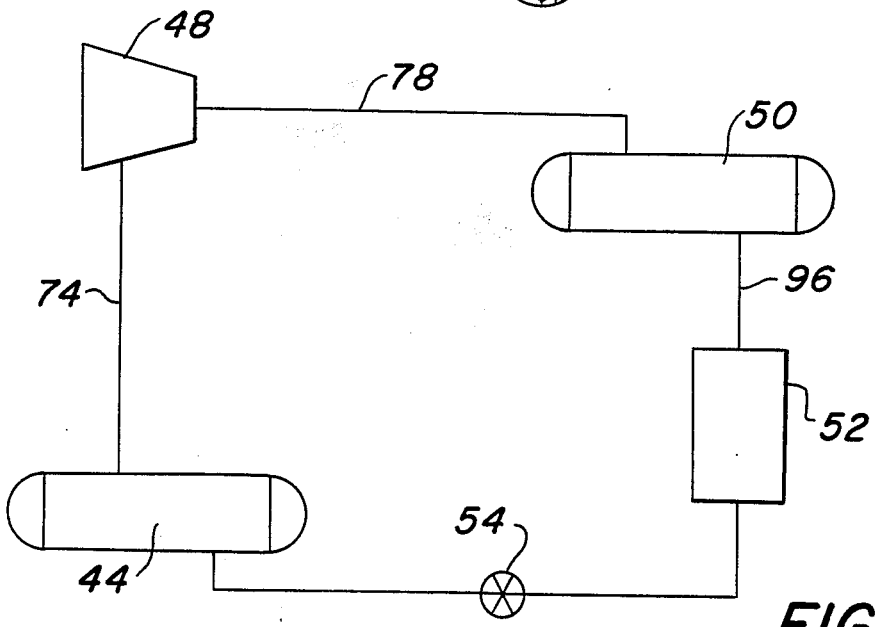
FIG. 7 is a schematic representation of the refrigerant flow through the present invention.

Referring to FIG. 7, a schematic representation of the refrigerant flow through the chiller is shown. Preferably, the refrigerant is Freon-12. It is preferred that the device utilize a minimum of 2 ounces of refrigerant. A compressor 48 communicates with a condensor 50 via conduit line 78. Condensor 50 is in communication with accumulator 52 via conduit line 96. Accumulator 52 is in communication with evaporator 44 via an expansion valve (capillary tubing) 54. Evaporator 44 is in communication with compressor 48 via conduit line 74. The chiller operates as a conventional vapor compression machine (mechanical refrigeration).

In the evaporator 44, the liquid refrigerant is vaporized and absorbs heat. The low temperature vaporized refrigerant from the evaporator 44 is drawn into the compressor 48. The compressor raises the pressure and temperature of the refrigerant (in a vapor state). The high pressure, high temperature, vapor refrigerant is passed to condenser 50. In the condenser, the vaporized refrigerant is condensed by the available circulating air. The refrigerant must be sufficiently compressed so that its saturation temperature is higher than the temperature of the available cooling medium. After heat removal has caused condensation, the liquid refrigerant is stored in accumulator 52. The high pressure liquid passes through the expansion valve 54 where the refrigerant throttles (drops) to the evaporator pressure of the system. In passing through expansion valve 54, the liquid refrigerant cools itself at the expense of the evaporating portion of the liquid. Such vapor compression machines are well known to those skilled in the art.

Compressor 48 is mounted to base 14 in any conventional manner, such as compressor mount 80. Compressor 48 can be any small, lightweight refrigerator compressor. The present invention utilizes a Sanyo refrigerator-compressor which, operates at 110 volts and has a 1.1 amp rating. The Sanyo compressor has a locked rotor rating of 2.75 amps with thermal overload protection. Compressor 48 is in communication with condenser 50 via compressor-condenser conduit line 78. A coupling 84 joins line 78 with the inlet side of condenser 50.

The thermal overload device 70 is a safety feature of the compressor. Device 70 senses the material temperature of the compressor. Device 70 will turn off the compressor and prevent the compressor from burning out, if the internal temperature of the compressor becomes too great. In the present invention, thermal overload device 70 is insulated from the interior of housing 12 by a foam material 88 which is applied to the interior of the device.

Condenser 50 is a conventional finned radiator. Such a radiator, although considerably greater size and weight, is typically found in room air conditioners. The condenser coil volume is about 69 cc. The fins, which are made of aluminum, have a surface area of approximately 335.24 square inches.

A fan 56 is mounted adjacent condenser 50 and adjacent inlet port 92. Fan 56 is rated at 16 watts and has a 50 cubic foot per minute throughput. The effective opening of the fan housing is 4.5 inches. The fan blows cooling air across condenser 50 and onto compressor 48. Air is exhausted through exhaust port 20.

Accumulator 52 is connected to condenser 50 via conduit line 79. Liquid refrigerant is stored in accumulator 52. Accumulator 52 is connected to evaporator 44 via capillary tubing 54. Tubing 54 acts as an expansion valve. Tubing 54 has a 20 thousandth of an inch I.D. and a length of approximately 2½ ft. Capillary tubing 54 wraps around evaporator 44 at least twice before coming in contact with evaporator inlet 72. Tubing 54 and inlet 72 are joined in any conventional manner. The tubing 54 could be replaced with a suitable needle valve (throttle valve).

Evaporator 44, which will be described in detail later, is connected to compressor 48 via conduit line 74. Line 74 is insulated from the interior of housing 12 by foam material 76. Insulation 76 prevents undue heating of the refrigerant before it enters the compressor. The heat from condenser 50 and compressor 48 makes the inside of housing 12 extremely warm. Likewise, insulation 88, within thermal load device 70, prevents overheating of the thermal overload circuit within the device.

Electrical line 46 provides the source of electrical power for the compressor and radio. All electrical connection for the compressor 48 and radio 68 are provided through an electrical connector 66. The electrical connections are well known in the art.

Figure 6:
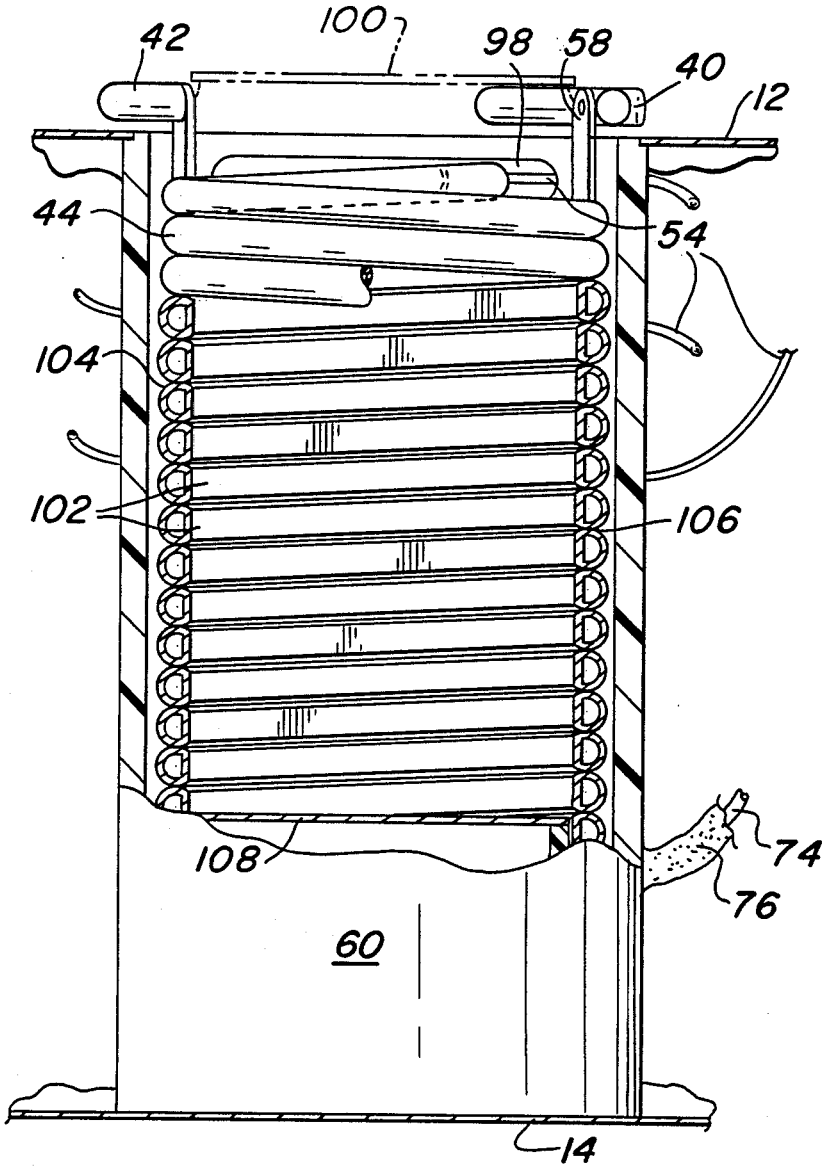
FIG. 6 is a side view of the evaporator of the present invention, parts being broken away for clarity.

Referring to FIG. 6, there is shown evaporator 44. Evaporator 44 is a coil of tubing. The tubing is formed from standard 3/16" I.D. copper tubing. But, the tubing could be enlarged to as much as ½" I.D. The coil is about 10 feet long. The evaporator has a volume of about 55 cc. Each ring of coil 44 is in ring to ring contact as indicated by 106. Each ring has a flattened inwardly facing surface 102. Surface 102 is flattened by drawing the tubing through a die. Surfaces 102 provide maximum surface contact between the cylindrical object (beverage can) and the evaporator 44.

Refrigerant from compressor 48 is introduced into condenser 50 at about 100 psi. Vaporized refrigerant exits evaporator 44 at an average pressure of 20 psi.

Evaporator 44 is placed within a cylindrical housing 60. Housing 60 is anchored to base 14. Housing 60 is made of a rigid thermal insulating plastic material. Housing 60 prevents unnecessary heat loss from and structural damage to the evaporator 44. A can rest or platform 108 is located at the lower portion of evaporator 44. Two diametrically opposed tabs 58 are fastened to the uppermost ring of evaporator 44. Tabs 58 project upwardly from evaporator 44 and extend through opening 26 of housing 12. A hook-shaped finger grip 40 is fastened to one tab. On the opposite tab 58, there is a finger hold 42. Opening 26 and housing 60 are coaxial with evaporator 44.

Figure 4:
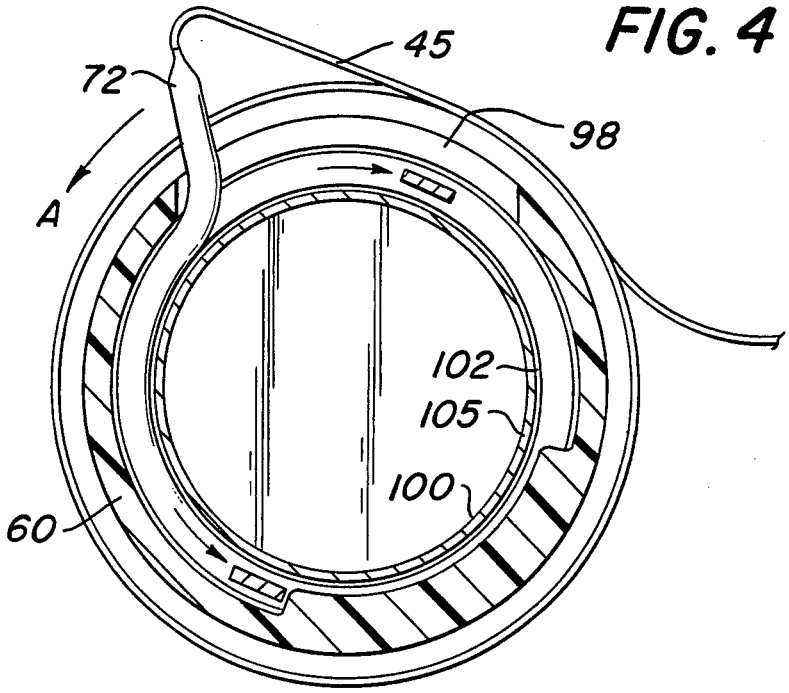
FIG. 4 is a top view of the evaporator in an open position.
Figure 5:
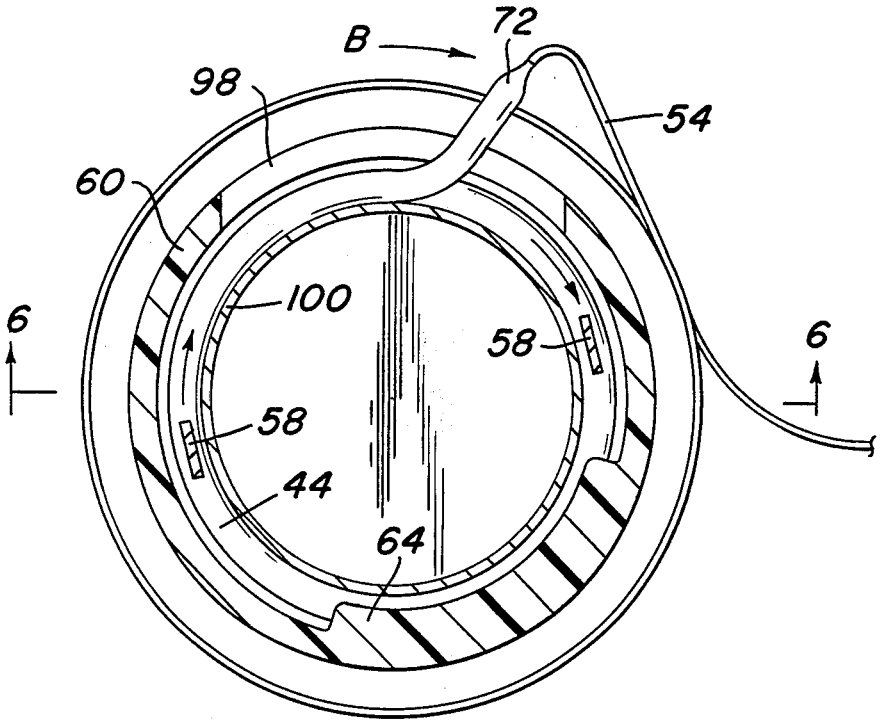
FIG. 5 is a top view of the evaporator in the closed position.

Inlet 72 of the uppermost ring of evaporator 44 extends through a slot 98 in housing 60. Slot 98 allows inlet 72 to be rotated in an angular direction. See arrows A, B in FIGS. 4 and 5. The lowermost ring of coil 44 is coupled to conduit line 74 in any conventional fashion. The end of the lowermost ring is anchored so that rotation of the uppermost ring results in reduction or expansion of the internal diameter coil 44.

Finger grip 40 and finger hold 42 are used to rotate evaporator coil 44 in an angular direction. Rotation of coil 44 in a counterclockwise direction (see arrow A in FIG. 4) expands the coil in a radial direction. When rotated in the counterclockwise direction, a small gap 105 is formed between surface 102 of coil 44 and the external surface of a can 100. This allows the can 100 to be freely slid or removed from evaporator 44. When finger grip 40 is allowed to rotate clockwise to the rest position (see arrow B, FIG. 5), gap 105 disappears and surface 102 makes physical contact with can 100. In this position, the can is locked within evaporator 44.

Cylindrical housing 60 is provided along its uppermost edge with a lip 64. Lip 64 maintains coil 44 below the upper surface of housing 12. Cylindrical housing 60 can be fitted with a lid (not shown).

Referring to FIG. 8, an alternate embodiment of evaporator 44′ is shown. Capillary tubing 54′ does not enter evaporator coil 44′ at inlet 72. Instead, inlet 72 is pinched closed and sealed so that no refrigerant can escape. Tubing 54′ enters evaporator coil 44′ at its base or where the coil is connected to the compressor via conduit 74 and preferably ahead of the beginning of the insulation 76. A hole (not shown) is made through the wall of coil 44′ at the lower most end of coil 44′. Tubing 54′ is passed through the hole. Tubing 54′ is threaded through coil 44′ to inlet 72, so that the tubing 54′ passes within the coil 44′. At inlet 72, tubing 54′ is bent back upon itself, so that the free end of the tubing points back down the coil 44′. Thus when the refrigerant passes through tubing 54′, it will be precooled by expanded refrigerant in the evaporator 44′ and as the refrigerant leaves the free end of the tubing 54′, it will be directed back down the coil 44′.

The present invention may be embodied in other specific forms without departing from the spirit or essential attributes thereof and, accordingly, reference should be made to the appended claims, rather than to the foregoing specification, as indicating the scope of the invention.

We claim:

1. A portable chiller device comprising:

compressing means for compressing a refrigerant;

condensor means for condensing said refrigerant, said condensor means being operatively connected to said compressing means such that compressed refrigerant is received from said compressing means by said condensing means;

accumulating means for accumulating said refrigerant, said accumulating means being operatively connected to said condensor means such that condensed refrigerant is received from said condensor means by said accumulating means;

expanding means for expanding said refrigerant, said expanding means being operatively connected to said accumulating means such that condensed refrigerant in said accumulator means can escape through said expanding means, said expanding means being a capillary tube having a free end; and evaporating means for evaporating said refrigerant, said evaporating means being operatively connected to said expanding means such that escaping condensed refrigerant will evaporate in said evaporating means, said evaporating means being operatively connected to said compressing means such that evaporated refrigerant can pass from said evaporating means to said compressor means, said evaporating means including a coil of tubing shaped to receive a generally cylindrical object which is to be chilled each ring of said coil being in direct contact with an adjacent ring, an inwardly facing surface of each ring being flattened so as to contact the object over a flattened surface, said coil being angularly rotatable such that when said coil is rotated in a first direction, said coil expands in a radial direction, and when said coil is rotated in a second direction, said coil contracts, said expansion and contraction thereby allowing said cylindrical object to be placed in, removed from or locked into said coil.

2. The device according to claim 1 including fan means for blowing air across said condensing means and said compressor means.

3. The device according to claim 1 wherein said refrigerant is Freon-12.

4. The device according to claim 1 wherein said condensing means is a finned radiator.

5. The device according to claim 4 wherein said finned radiator has a volume of about 69 cc.

6. The device according to claim 4 wherein said finned radiator has a surface area of about 335.24 square inches.

7. The device according to claim 1 wherein said fan means is located adjacent said condensor means.

8. The device according to claim 7 wherein said fan has a throughput of 50 cubic feet per minute.

9. The device according to claim 1 wherein said capillary tube has an I.D. of about a 20 thousandth inch.

10. The device according to claim 1 wherein said capillary tube is about 2½ feet long.

11. The device according to claim 1 wherein said evaporating means has a volume of about 55 cc.

12. The device according to claim 1 wherein said refrigerant in said evaporating means undergoes a pressure drop from about 100 psi to about 20 psi.

13. The device according to claim 1 further comprising a generally cylindrical housing which surrounds said evaporating means.

14. The device according to claim 12 wherein said generally cylindrical housing is formed of a rigid, heat insulating plastic.

15. The device according to claim 1 wherein said refrigerant has a weight of at least about 2 ounces.

16. The device according to claim 1 further comprising a housing having an opening therethrough, said opening and said evaporator means being coaxial.

17. The device according to claim 1 further comprising a means for locking a generally cylindrical object in said evaporating means.

18. The device according to claim 17 wherein said locking means includes a finger grip and a finger hold secured to said evaporating means.

19. The portable chiller device recited in claim 1 wherein said capillary tube enters said coil where said evaporator means is operatively connected to said compressor means, said capillary tube passing within said coil, the free end being bent to a point back down said coil.

20. The portable chiller device recited in claim 1 further comprising locking means for locking and unlocking said cylindrical object within the coil of tubing, said locking means comprising a finger grip and finger hold attached to the top of said coil, said grip and hold facilitating the angular rotation of said coil.

21. An evaporator for a chilling device comprising:

a coil of tubing shaped to receive an object which is to be chilled;

each ring of said coil being in contact with an adjacent ring; and an inwardly facing surface of each ring being flattened so as to contact the object over a flattened surface, said coil being angularly rotatable such that when said coil is rotated in a first direction, the coil expands in a radial direction, and when said coil is rotated in a second direction, said coil contracts, said expansion and contraction thereby allowing said object to be chilled to be placed in, removed from or locked into said coil.

22. The portable chiller device recited in claim 2I further comprising a capillary tube which enters said coil where said evaporator is operatively connected to a compressor means, said capillary tube passing within said coil, the free end being bent to point back down said coil.

23. An evaporator for a chilling device comprising:

a hollow chamber in which a refrigerant can expand, said chamber being shaped to receive an object which is to be chilled, said chamber being angularly rotatable such that when said chamber is rotated in a first direction, said chamber expands in a radial direction and when said chamber is rotated in a second direction, said chamber contracts, said expansion and contraction thereby allowing said object to be chilled to be placed in, removing from or locked into said chamber; and a capillary tube having a free end which enters said chamber at said chamber's lowermost end, said tube extending through said hollow chamber, said free end of said tube being bent to point back into said hollow chamber.

* * * * *